United States Patent [19]

Wyberg

[11] Patent Number: 4,872,562

[45] Date of Patent: Oct. 10, 1989

[54] GABLE-TOP CONTAINER

[75] Inventor: Gregory R. Wyberg, Minneapolis, Minn.

[73] Assignee: Minnesota Mining and Manufacturing Company, St. Paul, Minn.

[21] Appl. No.: 160,403

[22] Filed: Mar. 9, 1988

Related U.S. Application Data

[63] Continuation-in-part of Ser. No. 36,908, Apr. 10, 1987, Pat. No. 4,762,234.

[51] Int. Cl.[4] ..... B65D 5/06

[52] U.S. Cl. ..... 206/631.3; 229/3.5 R; 229/137

[58] Field of Search ..... 229/137, 138, 125.42, 229/123.1, 3.5 R; 206/631, 631.2, 631.3, 632; 220/457

[56] References Cited

U.S. PATENT DOCUMENTS

| | | | |
|---|---|---|---|
| 2,719,100 | 9/1955 | Banigan | 229/3.5 R |
| 2,750,095 | 6/1956 | Alden | 229/17 |
| 3,081,927 | 3/1963 | Hayhurst | 229/17 |
| 3,116,002 | 12/1963 | Crawford et al. | 229/17 |
| 3,120,089 | 2/1964 | Monroe et al. | 53/86 |
| 3,178,089 | 4/1965 | Tobias et al. | 229/17 |
| 3,192,091 | 6/1965 | Hey et al. | 206/631 |
| 3,239,995 | 3/1966 | Monroe et al. | 53/375 |
| 3,245,603 | 4/1966 | Wilcox | 229/17 |
| 3,270,940 | 9/1966 | Egleston et al. | 229/17 |
| 3,297,227 | 1/1967 | Wallsten | 229/17 G |
| 3,309,841 | 3/1967 | Egleston et al. | 53/373 |
| 3,334,799 | 8/1967 | Crawford | 229/17 |
| 3,452,919 | 7/1969 | Avolio | 229/17 |
| 3,554,430 | 1/1971 | MacEwen | 229/17 |
| 3,560,223 | 2/1971 | Turbak | 229/3.5 R |
| 3,675,015 | 7/1972 | Geib | 229/17 G |
| 3,827,625 | 8/1974 | Miller | 229/62 |
| 4,008,347 | 2/1977 | Amberg et al. | 220/457 |
| 4,211,357 | 7/1980 | Lisiecki | 229/17 G |
| 4,313,553 | 2/1982 | Lisiecki | 229/17 G |
| 4,390,121 | 6/1983 | Lisiecki | 229/17 G |
| 4,433,784 | 2/1984 | Kjelgaard | 229/17 R |
| 4,488,647 | 12/1984 | Davis | 206/631 |
| 4,527,732 | 7/1985 | Smith | 229/17 G |
| 4,576,285 | 3/1986 | Goglio | 206/632 |
| 4,712,727 | 12/1987 | Wyberg | 206/631.3 |

*Primary Examiner*—Gary Elkins

*Attorney, Agent, or Firm*—Donald M. Sell; Walter N. Kirn; Leland D. Schultz

[57] ABSTRACT

A gable-top container made from a scored blank of paperboard and the like includes at least one fillet permanently attached to the outside surface of at least one of the panels which form the spout. The fillet comprises a thin strip of stiff material constructed of unoriented polypropylene coated with a layer of adhesive. The strip is resistant to the carton-sealing process, and extends along a major portion of the panel length to transfer to .applied container-opening forces to the tip of the spout preventing buckling of the spout panels. In the preferred embodiment, the portion of the fillets on the adjoining panels about one another when the spout is in a closed condition. A secondary layer of adhesive having a lesser bonding force may overlay the abutting portions of the fillets to controllably seal opposing panels to each other at the particular desired bond strength.

9 Claims, 7 Drawing Sheets

GABLE-TOP CONTAINER

This application is a continuation-in-part of co-pending U.S. patent application Ser. No. 36,908 filed April 10, 1987 and entitled "Gable-Top Container," now U.S. Pat. No. 4,762,234 issued 8/9/88.

BACKGROUND OF THE INVENTION

1. Field of the Invention

This invention relates to packaging, and particularly to an improved package construction using a pressure sensitive adhesive tape material to improve the opening characteristics of a disposable, gable-top container suitable for the packaging of liquids. More particularly, this invention relates to a blank from which the container is formed.

2. Description of the Prior Art

Containers for beverages such as milk, fruit juices, and drinks are conventionally constructed from blanks of thermoplastic coated paperboard. The most widely used of such containers have a rectangular cross-sectional body surmounted by a gable-top closure incorporating an extensible pouring spout. Blanks from which the containers are constructed are divided into a plurality of panels which are adapted to form the walls and closure members. The panels are formed and separated by score lines at which the blank is folded. Particular panels are intended to be joined together in a lapped arrangement in the completed container. Typically, those panels are pressed together and heated or exposed to high frequency radiation to fuse the adjoining thermoplastic surfaces and form a generally strong seal. To finally seal the filled container, two or more panels are finally joined and sealed to form rib along the top edge of the roof panels. Exemplary of such container blanks are those shown in Alden U.S. Pat. Nos. 2,750,095 and Wilcox 3,245,603.

Containers of this type are opened for access to the contents by a two-step toggle action process. First, the gable edges of the roof panels at the front of the container are pushed outward and upward toward the rear of the container by thumb pressure, breaking the seal between the outside surfaces of the two lip panels, and breaking the seal in the rib panels surmounting the roof above the pouring spout. The gable edges are forced backward past the point at which the lip panels are joined, to nearly tough the roof panels.

Second, the gable edges are pushed forward and inward. The second stage opening forces are communicated through spout panels to the tip of the pouring spout, breaking the seal between the lip panels and the underside of the roof panels and snapping the spout outward to a pouring position.

The first step in the opening process primarily produces tension forces in the spout panels, while the second step produces compression forces, and these forces are transmitted over a greater distance. Thus, the second opening stage is more likely to result in bent and crumpled spout panels.

In early models of gable-top containers, the panels comprising the lips, i.e. gable rib panels of the pouring spout were bonded to the underside of the roof panels. The resulting sealed spout was difficult to open, generally requiring insertion of a tool behind the lips to separate them from the roof underside. The cardstock panels often tore or delaminated, producing an unsightly and unsanitary container. In those cases where an adhesive was applied to only those panels which were to be joined, it was simple to eliminate adhesive from the spout panels to reduce the forces required to open the spout. The resulting container, of course, was not effectively sealed and was subject to leakage.

An improvement in gable-top containers to provide a hermetic seal for an extended shelf life package consisted of coating the inner surface of the container blank with a foil or other gas-impermeable layer and an overcovering layer of thermoplastic such as polyethylene. The panels to be sealed are bonded by heating the thermoplastic surface coatings to a softening or melting temperature, compressing the panels together and cooling. The use of thermoplastic coatings or foil adds some stiffness to the panels, and the container is made resistant to wicking by liquids. However, polyethylene has a low modulus of elasticity, and the added stiffness is minimal. The strong thermoplastic bonding of the lip panels results in buckling, tearing and delamination of the cardstock upon opening the seal. Thus, the spout is difficult to open, and the opened panels are unappealing in appearance.

As used in the food packaging industry, the term hermetic refers to a container designed and intended to be secure against the entry of oxygen which degrades flavor. The term is also used to designate containers used for aseptic filling and storage, i.e. containers secure against the entry of microorganisms. The hermetic barrier of such cartons typically comprises an aluminum or other barrier film coating the inner surface, overcovered with a thermoplastic such as polyethylene. The carton wall thickness is thus increased, requiring significantly greater forces to open the container, particularly in the second step of the opening process. Attempts to provide an easily opened spout seal for hermetically sealed and other gable-rib cartons have included (a) perforations in the spout panels which tear open to expose pouring lips, (b) improved control of the sealing temperature, (c) the use of added scoreline patterns to concentrate the opening forces, and (d) the use of anti-adhesion agents, i.e. abhesive, to reduce the required opening forces.

The use of perforations in the spout panels has generally been unsatisfactory. Such perforations produce a spout of reduced size, which requires special sealing operations. The perforations are considered by some to be a weak point in the carton, prone to develop leaks. This type of carton spout requires external forces such as thumbnail pressure to open, and this procedure is considered unsanitary. The carton cannot be effectively closed, once opened, and shaking of the carton results in spillage.

Likewise, efforts to reduce temperature variations in the sealing process have not produced a satisfactory hermetic sealing gable-top container. The desired adhesion is obtained within a narrow range of temperature, and temperatures either higher or lower may produce excessive or inadequate sealing. Variations in sealing persist in spite of improved temperature control. Moreover, the required opening forces generally exceed the panel strength, even where minimal sealing is achieved.

The use of novel scoreline patterns generally has not overcome the strong sealing forces of well-sealed spouts and buckling of the spout panels is common.

One method for preventing the difficulty in opening the completely bonded lip panels of polyethylene coated gable-top containers is shown in Crawford et al, U.S. Pat. No. 3,116,002 In this reference, a thin coating of a high molecular weight organo-siloxane gum is applied to the lip panels as an abhesive, that is, to prevent permanent adhesion to the panels in contact with the lip panels.

Egleston et al, U.S. Pat. No. 3,270,940 discloses the use of an anti-adhesive composition applied to both the outside and inside surfaces of the pouring lip of a gable-top container. Abhesive agents disclosed include cellulose plastic laminated to polyethylene, the latter heat-bondable to the polyethylene surface of the cardstock blank.

The release properties of abhesives are generally affected by the heat sealing parameters and are inconsistent. Containers designed for hermetic use and having adhesives in the spout sealing area often require opening forces greater than the wall strength of the panels, and the spout panels buckle during the opening process.

SUMMARY OF THE INVENTION

The present invention is directed to an improvement in the formation of a package of paneled flexible material to stiffen the package material adjacent the sealed area to be opened. The result is a more reliable, consistently openable opening for gaining access to the contents. The flexible material may be cardstock plastic, or other material with a thermoplastic inner surface coating which is sealed by elevated temperature and pressure. The flexible material may include a gas-impermeable film or foil layer. A blank of the package material with scoreline-defined panels is folded into the package shape and overlying panels are sealed. A typical sealing process consists of heating with hot air to a temperature which melts or fuses the thermoplastic surface coatings, and compressing together the panels to be joined.

A container body is provided having sides, a top, and a bottom suitable for the packaging of liquids. The container body in the illustrated embodiment includes a front body panel, a back body panel and first and second side panels. Bottom closure panel means is provided for closing the bottom of the gable-top container. Connected to the upper edges of the first and second side panels are the first and second roof panels, respectively. When assembled, the roof panels are oppositely disposed to converge upwardly, and are connected at their top edges to form a gable roof. The front edges of the roof panels have score lines defining subpanels which comprise first and second roof wing panels. The wing panels form the rear portion of the pouring spout.

First and second opposed, substantially triangular end panels are connected to the upper edges of the front and back body panels to extend upwardly therefrom. The first triangular end panel, the first and second wing panels, and the panels listed below comprise an extensible pouring spout connected to the top of the container body.

A first foldback panel is connected to the first roof wing panel and to one lateral edge of the first triangular end panel. A second foldback panel is connected to the second roof wing panel and to the other lateral edge of the first triangular end panel.

A third foldback panel is connected to the other end of the first roof panel and to one lateral edge of the second triangular end panel. A fourth foldback panel is connected to the other lateral edge of the second triangular end panel, and is adapted to be connected to the second roof panel, opposite the second foldback panel.

First and second gable rib panels are connected to the upper edges of the first and second foldback panels, respectively, and extend upwardly therefrom. These gable rib panels are also connected to each other at a common line, and comprise lips of the pouring spout from which the container contents are discharged.

Third and fourth gable rib panels are connected to the upper edges of the third and fourth foldback panels, respectively, and extend upwardly therefrom.

First and second roof rib panels are connected to the upper edges of the first and second roof panels, respectively, and extend upwardly therefrom. Each roof rib panel is connected at one side thereof to one of the first and second gable rib panels.

First and second upper rib panels are connected to the upper edges of the first and second roof rib panels, respectively, and extend upwardly therefrom.

At least one stiffening or reinforcement fillet overlays a portion of, and is bonded to, the outer surface of at least one of the pouring spout panels. The fillet comprises (a) a strip of material constructed of unoriented polypropylene resistant to the container sealing process, i.e. it will not melt, or otherwise degrade at the temperature and pressure of the sealing process, and (b) a layer of adhesive bondingly attached to one side of the strip and to the outer surface of the gable rib panel or panels overlain by the fillet.

The fillet stiffens the panels to which it is bonded, enabling higher applied opening forces to be transferred to the common line connecting the gable rib panels of the spout of the erected, sealed container, to open the seal.

The fillet extends along a major portion of the force transmission line between the site where the second stage opening force is applied and the intersection of the gable rib panels which receives the opening force. The fillet strengthens the panel to which it is bonded, so that the force transmitted therethrough will break the spout seal between the gable rib panels and roof rib panels before those panels fold, tear or delaminate.

DETAILED DESCRIPTION

Figure 1:
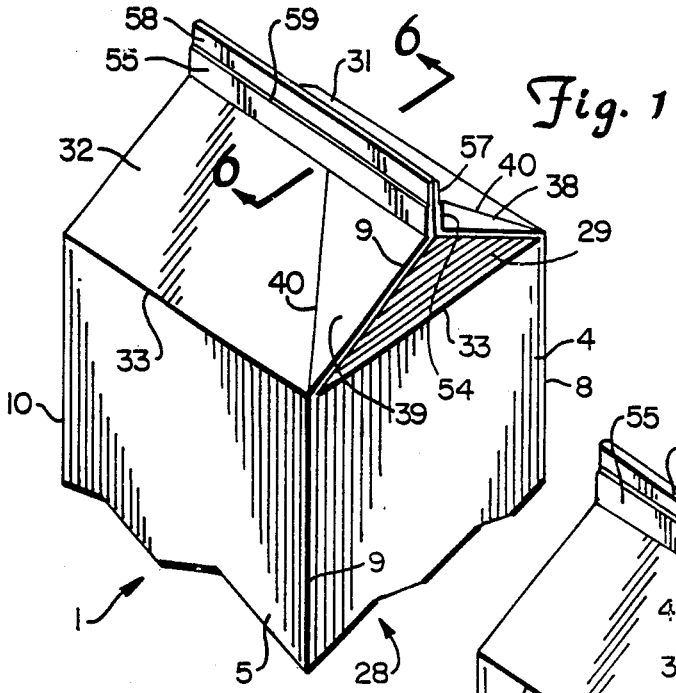
FIG. 1 is a perspective view of the upper end of a closed container formed from a blank according to an embodiment of the present invention.

Referring now to the drawings, the invention is depicted with reference to a gable-top container in which the invention is incorporated. A gable-top container is formed from a blank of paperboard or other suitable material which may optionally be coated on the inner planar surface and/or outer planar surface with a thermoplastic material. The container blank is adapted to be folded along horizontal and vertical fold lines, erected, and have certain panels sealed to each other by a container sealing process. For thermoplastic coated container blanks, the sealing process typically consists of compressing together the panels to be joined while those panels are at an elevated temperature. Other alternative sealing processes may also be utilized, such as the application of adhesive to the panels to be sealed.

FIG. 1 shows a typical container 1 in a closed, sealed condition as for storage of beverages and the like. The container is self-sustaining in shape.

Container 1 is comprised of a series of panels, including a container body having four body panels 2–5 which make up the body 28. Front body panel 4 and second side body panel 5 are shown in FIG. 1, while rear body panel 2 and first side body panel 3, not shown, oppose panels 4 and 5, respectively, forming a container of rectangular cross-section. Usually, the cross-section is square. The bottom of the container 1 is closed. First roof panel 31 is connected to the upper edge of first side panel 3. Second roof panel 32 is connected to the upper edge of second side panel 5. When the container is in the closed condition, the roof panels 31 and 32 converge upwardly to form a gable roof construction. Second roof rib panel 55 is attached to second roof panel 32 and extends upwardly therefrom. Likewise, second upper rib panel 58 is attached to second roof rib panel 55 and extends upwardly therefrom.

In the same manner, first roof rib panel 54 is attached to first roof panel 31 and extends upwardly therefrom. First upper rib panel 57 is attached to first roof rib panel 54 and extends upwards therefrom.

First triangular end panel 29 is connected to the upper edge of the front body panel 4. When the container is closed, end panel 29 is folded under the gable roof formed by the two roof panels. Also shown are first roof wing panel 38 and second roof wing panel 39. The roof wing panels 38 and 39 are subpanels of roof panels 31 and 32, respectively. A second triangular end panel, not shown in this figure, is usually adapted to remain folded under the opposite gable roof, unless it is desired to open both gable ends of the container.

Figure 2:
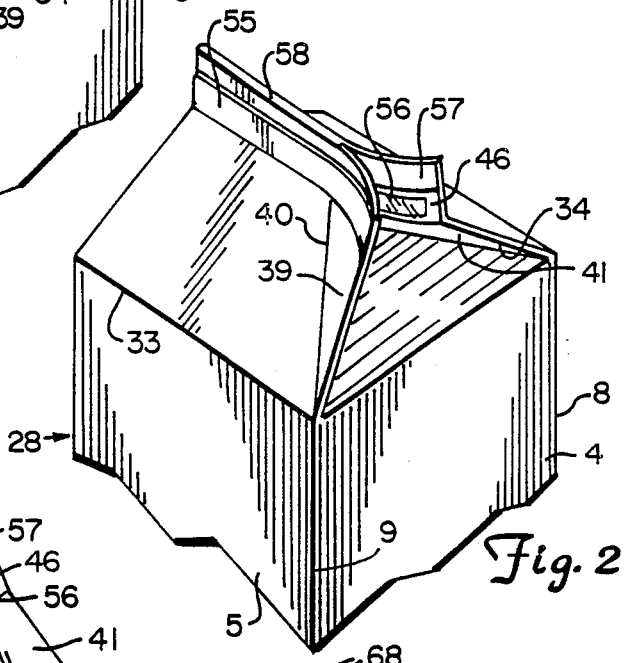
FIG. 2 is a perspective view of the container end of FIG. 1 with a partially opened rib.

FIG. 2 shows the container of FIG. 1 in which the spout has been partially opened. The first and second foldback panels 41 and 42 and overlapping roof wing panels 38 and 39 are typically pushed outward and backward with thumb pressure to break the seal between the inner surfaces of the first and second upper rib panels 57 and 58, and between the outer surfaces of the first and second gable rib panels 46 and 47, the latter panels not visible in this drawing. The gable rib panels 46 and 47 are connected to the upper edge of foldback panels 41 and 42, and extend upwardly therefrom.

Figure 3:
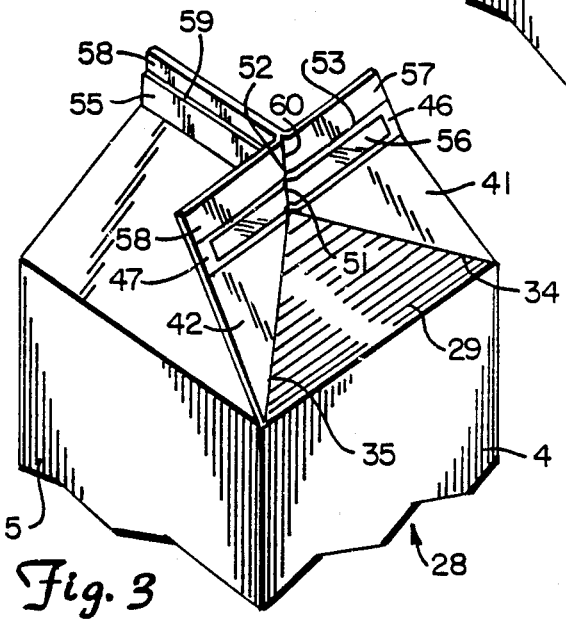
FIG. 3 is a perspective view of the container end of FIG. 1 with its sealed spout rib fully open and the spout panels in the closed position.

FIG. 3 shows the container at the point where foldback panels 41 and 42 have been pushed backward about 90 degrees from their sealed position. These panels are roughly triangular in shape, each having one edge defined by scoreline 34 or 35, where they are attached to a lateral edge of first triangular end panel 29. First and second gable rib panels 46 and 47 act as lips of the pouring spout, and meet at a common gable rib score line 51. The upper terminus 52 of the common rib score line 51 at the free edge 53 of the pouring lip comprises the tip of the pouring spout. First and second upper rib panels 57 and 58 extend upwardly from the first and second roof rib panels 54 and 55 to a level higher than the free upper edge 53 of gable rib panels 46 and 47.

To complete the unsealing and opening of container 1, foldback panels 41 and 42 are pushed backward beyond the position shown in FIG. 3. The roof rib panels 54 and 55 and upper rib panels 57 and 58 will fold along foldline 60. The blank may or may not be scored at that location.

When opened, the gable rib panels 46 and 47 are slightly longer than the unfolded portion of the roof rib panels 54 and 55. After the panels are folded backward, a subsequent forward and inward movement of wing panels 38 and 39, gable rib panels 46 and 47, roof rib panels 54 and 55, and upper rib panels 57 and 58 transmits opening forces in a toggle-like action along the wing panels and gable rib panels and toward the common line 51 between the gable rib panels. The forces further shorten the folded portion of the roof rib panels 54 and 55. A component of the applied forces extends outward and upward from line 51 and from end panel lateral edges 34 and 35 to pull the gable rib panels 46 and 47 away from roof rib panels 54 and 55, the latter not visible in FIG. 3, and to pull foldback panels 41 and away from roof wing panels 38 and 39. Likewise, triangular end panel 29 is forced outward, and the distended panels create a pouring spout. The various score lines delineating the panels act as hinges for the panels as they are unfolded.

The force required to distend the spout in this fashion may be calculated theoretically. If the gable rib panels are looked upon as a beam which is to be buckled in the center, the force P required for bucking to occur may be described as:

$$P = CEI/(L^2)$$

where:

$C = (pi^2) = 9.87$ for hinged ends.

E = modulus of elasticity of beam.

I = moment of inertia of the beam.

$I = bh^3/12$ where b = width and h = thickness of the beam.

and L = length of the beam.

Analysis of the opening forces is complex. In general however, the gable rib panels, foldback panels, and roof rib panels must be relatively stiff to prevent the panels from crumpling, and to transmit the applied opening forces to common line 51. The sealing forces which bond the gable rib panels to the roof rib panels are preferably only as high as required to maintain the desired seal. A nominal liquid-tight seal common in milk cartons may be achieved with minimal or no bonding of gable rib panels to roof rib panels, while a hermetic seal requires relatively high strength bonding over the continuous panel interface.

High bonding forces between the gable rib panels and the roof rib panels will require greater stiffness in the spout panels to prevent buckling of the panels during the opening process.

The features of this invention will produce an openable container spout seal, regardless of whether the seal is merely liquid-tight or is hermetic, i.e., gas-tight. As illustrated in FIG. 3, one or more fillets 56 overlie a portion of one or both of the gable rib panels 46 and 47. The construction of fillet 56 is further described in reference to FIG. 4.

Figure 4:
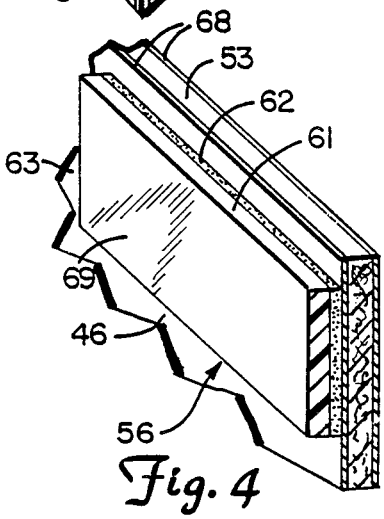
FIG. 4 is a perspective view of a portion of a stiffening fillet attached to a container panel according to the present invention. The cross-section of the fillet and panel are enlarged to show the laminar construction.

As shown in an enlarged perspective sectional view in FIG. 4, each fillet 56 comprises a stiffening strip 61 and an adhesive layer 62 by which the strip is attached to the outside surface 63 of a portion of one of the pouring spout panels, such as gable rib panels 46 and 47 as shown. In this embodiment, one surface 69 of strip 61 remains free of adhesive. When the container spout is closed, surface 69 on one gable rib panel abuts surface 69 on the other gable rib panel. The bond between the two surfaces 69 may be weak or strong, but in any case is less than the strong bond created by the layer 62 of adhesive which bonds the strip or strips 61 to the respective gable rib panels.

Figure 5:
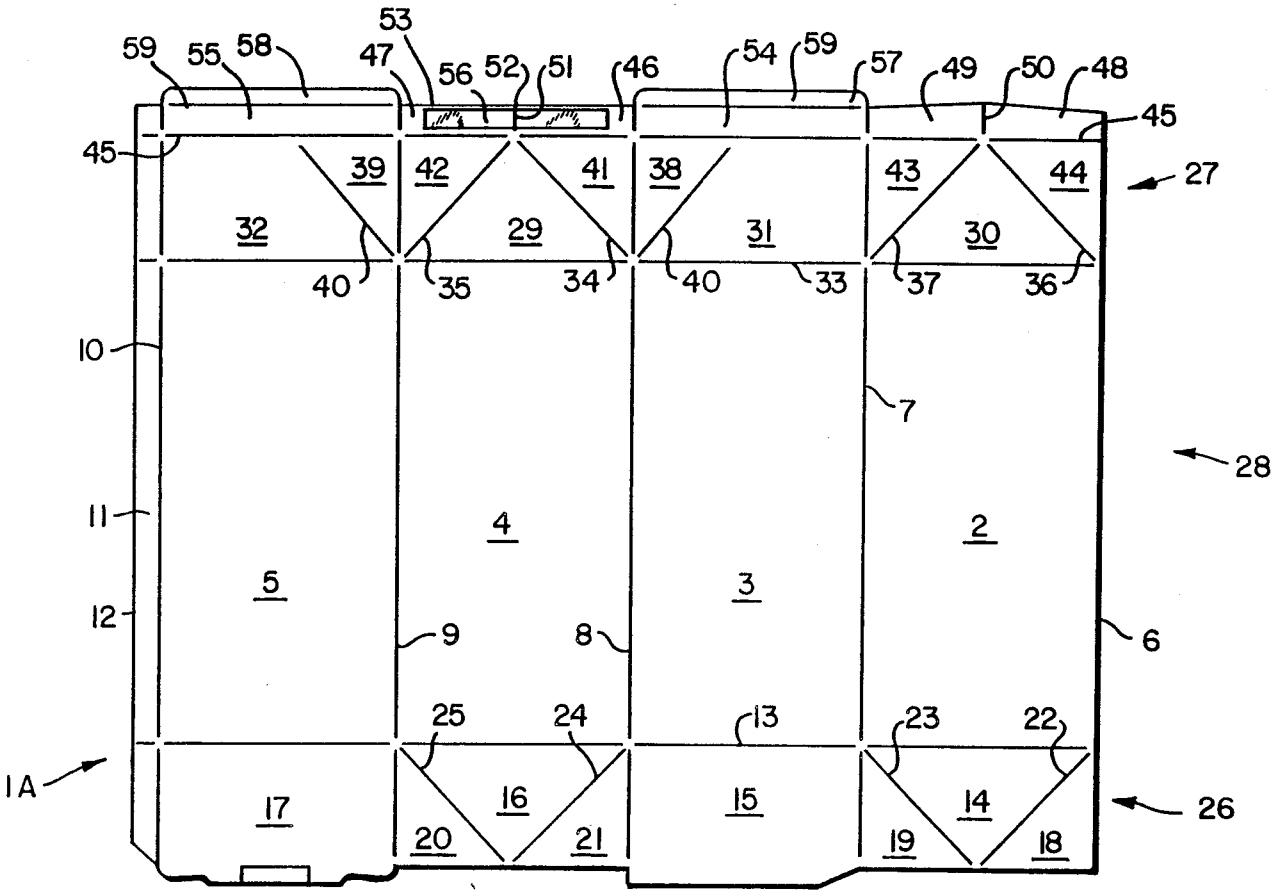
FIG. 5 is a plan view of an embodiment of the container blank according to the invention.

FIG. 5 illustrates an exemplary flat sheet material blank of this invention for constructing a gable-top container. The outer surface or face is shown, and it may be coated with a thermoplastic such as polyethylene. The inner surface may also be similarly coated. The sheet material may include a gas impermeable layer such as aluminum foil. An appropriate pattern of score lines divides blank 1A into a plurality of panels and sub-panels which are used as walls of the container and its closure parts when the container is erected.

The central portion of blank 1A comprises a body 28 with four body panels 2, 3, 4, and 5, having their lower edges along bottom score line 13, and their upper edges along top score line 33. These transverse score lines are shown as extending from blank edge 6 to opposite blank edge 12 in substantially parallel relationship across the face of the blank. Vertical score lines 7, 8 and 9 transect the blank to define the lateral edges of the body panels 2, 3, 4 and 5, and other panels above the body panels. These and other score lines are not necessarily straight, but may be slightly offset in certain sectors of the blank to improve the fit of the various panels in the erected container.

In the example shown in FIG. 5, side seam flap 11 is connected to one lateral edge 10 of a body member for sealing to the edge of another body member 2 by the container sealing process. Bottom closure means 26 is shown as a group of bottom closure panels 14 through 21 attached to the body members along bottom score line 13, and extending downward therefrom. Bottom closure score lines 22 through 25 enable bottom closure panels 14, 16, and 18–21 to be folded under closure panels 15 and 17 and sealed to provide a leakproof container bottom. Such a closure means is well-known in the art. A separately formed structure may alternatively be used to close the bottom of the container. In fact, any closure means which results in a satisfactorily tight seal may be used.

The gable top of the container is formed from a series of panels above top score line 33. First and second roof panels 31 and 32 are connected to the upper edges of the first and second side panels 3 and 5, respectively. The roof panels are oppositely disposed and when erected, converge upwardly to meet along score line 45 to form a gable roof. Connected to the upper edge of the front panel 4 is a first substantially triangular end panel 29 whose two lateral edges 34 and 35 formed by score lines extend upwardly to score line 45. Similarly, second triangular end panel 3 is connected to the upper edge of back panel 2, and has lateral edges 36 and 37 which extend upwardly to score line 45.

On each side of triangular end panel 29 is a foldback panel. First foldback panel 41 is connected to triangular end panel 29 along edge 34, and to first roof wing panel 38 along score line 8. Panel 41 has score line 45 as its upper edge. Similarly, second foldback panel 42 is connected to triangular end panel 29 along edge 35, and to second roof wing panel 39 along score line 9. It has score line 45 as its upper edge.

Similarly, third and fourth foldback panels 43 and 44 are connected to triangular end panel 30 along lateral edges 37 and 36, respectively. When the carton is erected, the fourth foldback panel 44 is attached to the second roof panel 32 by flap 11. Edge 6 is then generally continuous with scoreline 10. The third foldback panel 43 is connected to the first roof panel 31 along scoreline 7.

Attached to the upper edge of each foldback panel 41, 42, 43 and 44 along score line 45 is a gable rib panel 46, 47, 48 and 49, respectively. Similarly, attached to the upper edge of first and second roof panels 31 and 32 are first and second roof rib panels 54 and 55, respectively. First and second gable rib panels 46 and 47 are connected to each other at a common score line 51, and third and fourth gable rib panels 48 and 49 are connected to each other at common score line 50. The uppermost end 52 of line 51 is the tip of the pouring spout of the erected container.

First gable rib panel 46 is connected to first roof rib panel 54 at score line 8, and second gable rib panel 47 is connected to second roof rib panel 55 at score line 9.

First roof wing panel 38 comprises a triangular portion of first roof panel 31 defined by score lines 40, 45 and 8, and is adjacent first foldback panel 41. Second roof wing panel 39 comprises a triangular portion of second roof panel 32, and is defined by score lines 40, 45 and 9. Panel 39 is adjacent second foldback panel 42. These roof wing panels are more or less coextensive with the adjacent foldback panel when the erected container is closed.

A first upper rib panel 57 is connected to the upper edge of the first roof rib panel 54. Likewise, a second upper rib panel 58 is connected to the upper edge of the second roof rib panel 55. The score line 59 separates the upper rib panels from the adjacent roof rib panels, and is substantially continuous with the free upper edge 53 of the first and second gable rib panels 46 and 47. The latter panels serve as lips of the pouring spout of the erected container.

The score lines may be applied to blank 1A before or after an optional thermoplastic coating is applied to the blank. The score lines may be applied to either surface or both surfaces of the blank. For purposes of clearer delineation of the various panels, score lines are shown in the drawings on either or both of the inner and outer surfaces of the blank and container.

In the embodiment shown in FIG. 5, a single stiffening fillet 56 overlies portions of the first and second gable rib panels 46 and 47. Fillet 56 comprises a strip 61 of stiff material having a layer 62 of adhesive on one surface, by which the strip is bondingly attached to the outer surface 63 of the gable rib panels 46 and 47. Strip 61 may be formed from any solid material which is resistant to deleterious effects of the container sealing process, and is sufficiently rigid so that, together with adhesive layer 62, it provides sufficient strength to reinforce the panel to achieve the necessary stiffness. Thus, for some containers, the modulus of elasticity of strip 61 must be at least 100,000 psi ($0.7\times10^8$ kg/m$^2$), and is preferably at least 200,000 psi ($1.4\times10^8$ kg/m$^2$). For hermetic sealing cartons and other containers with relatively heavy gauge walls, the modulus of the strip is preferably at least 400,000 psi ($2.8\times10^8$ kg/m$^2$).

Strip 61 must not melt, or otherwise degrade at the conditions, e.g., elevated temperature and pressure, of the container sealing process. Of course, a container sealing process of significant compression of the panels at an elevated temperature my tend to increase the area of intimate contact and relieve elastic stresses, causing adhesion of the abutting strip surfaces 69, or adhesion of strip surface 69 to the panel outer surface 63, if fillet 56 is present on only one of the gable rib panels 46 or 47. The bond strength of this pressure-produced adhesion will, however, be significantly less than the bond strength of the adhesive layer 62 which bonds strip 61 to the gable rib panel 46 or 47.

Figure 9:
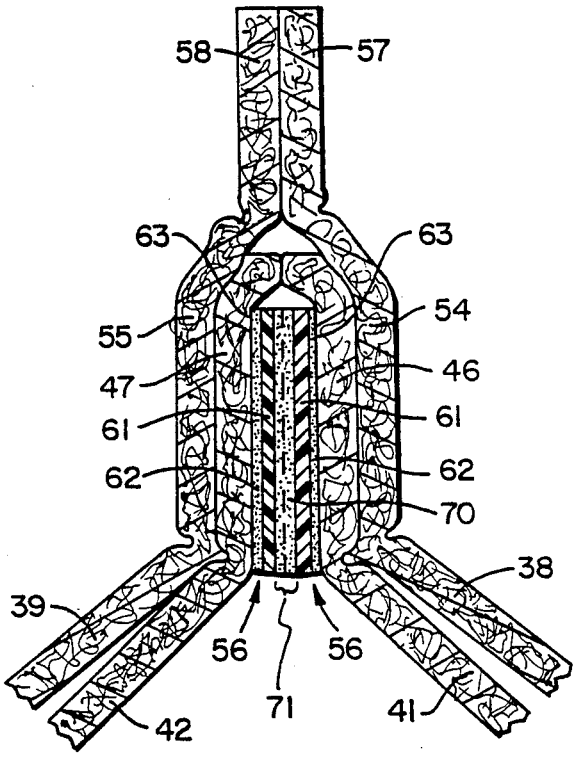
FIG. 9 is a cross-sectional view through the closed upper closure of another embodiment of the invention taken along line 6—6 of FIG. 1.
Figure 10:
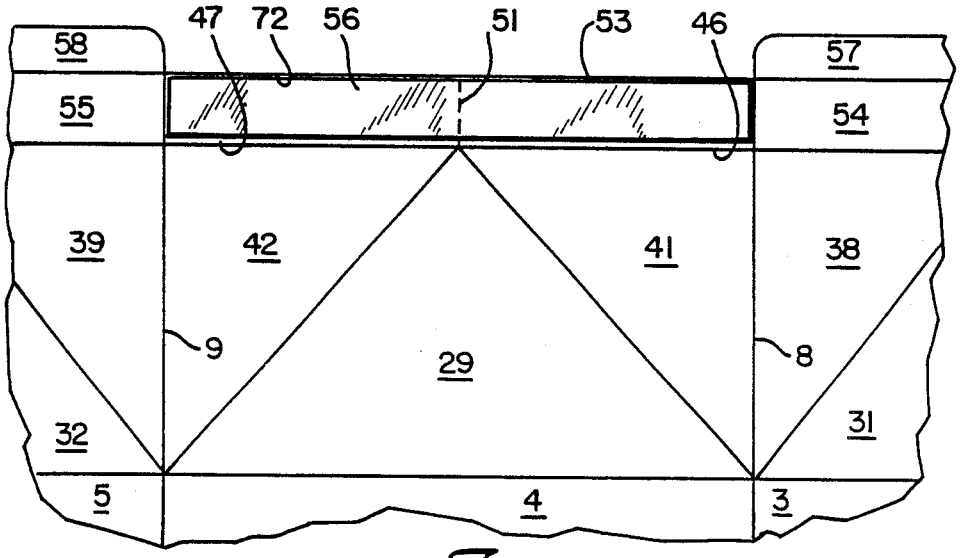
FIGS. 10 through 13 are plan views of a portion of the outer face of various embodiments of the present invention.
Figure 12:
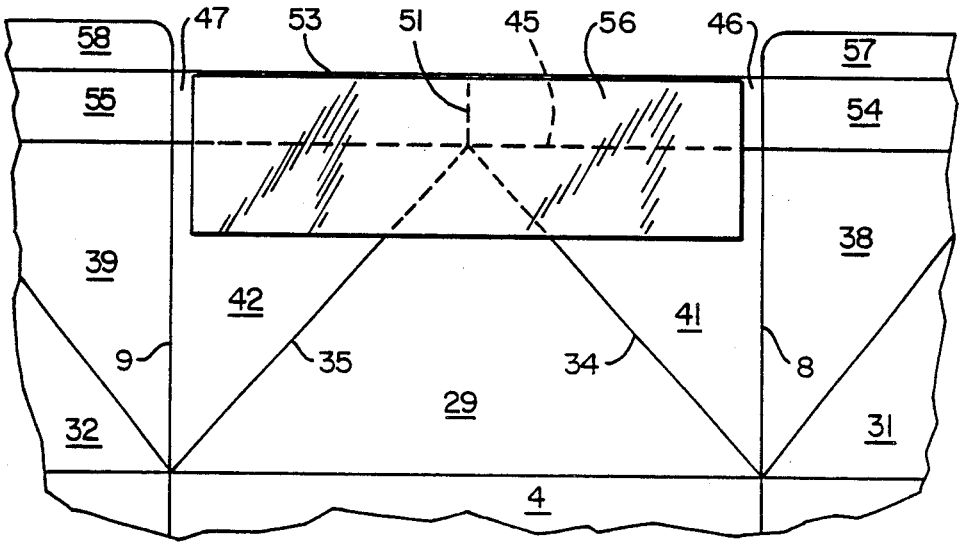
Figure 13:
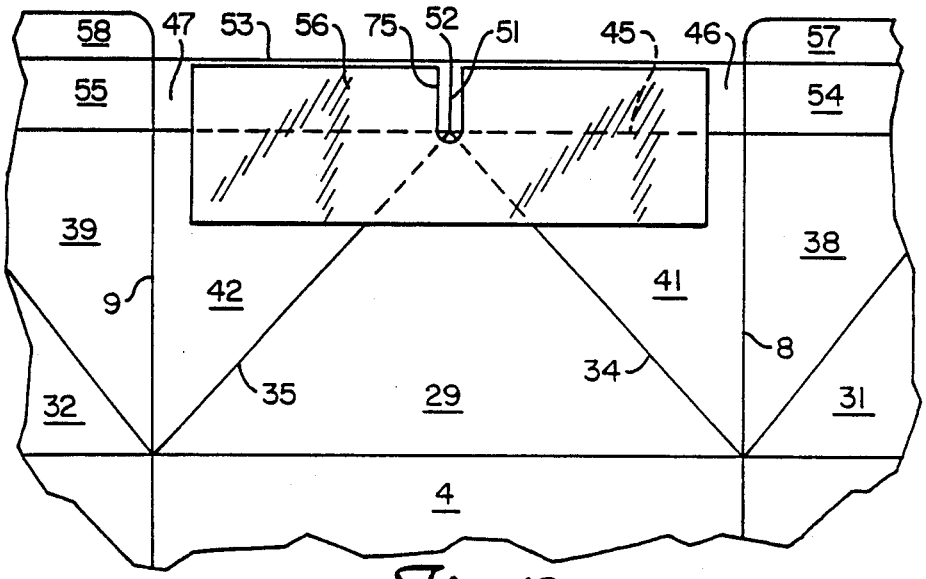

Material such as metallic foil, polyester film, and polycarbonate film are examples of strip materials which are unaffected by the temperatures used for sealing panels coated with polyethylene, and have a sufficiently high modulus of elasticity. Thermoplastic coatings like polyethylene are typically sealed at temperatures of 250° to 400° F. (81° and 205° C.). In the most preferred embodiment of the invention, the material of the strip is unoriented polypropylane, such as that utilized as a film backing in a pressure sensitive adhesive tape marketed under the trademark "Y-8450" by Minnesota Mining and Manufacturing Company of St. Paul, Minnesota. A fillet constructed of unoriented polypropylene exhibits several advantages over strips constructed of other materials. Specifically, unoriented polypropylene has a lower modulus of elasticity than polyester (i.e. as low as $0.2\times10^6$ psi). Therefore, a more compliant strip may be constructed which is better able to conform to the scorelines between the pouring spout panels. Thus, a notch, such as is shown in FIGS. 9, 10 and 12 and discussed hereinafter, is not required. This simplifies the process of positioning and aligning the fillet on the panels. The optmium temperature range per bonding the unoriented polypropylene strip is 260°–320° F. Unoriented polypropylene is the preferred material for the strip in that it is dimensionally stable, even when subjected to the elevated temperatures and pressures experienced when a container is sealed. Oriented polypropylene, although having increased tensile strength, has a tendency to return to its unoriented state when exposed to temperatures (i.e., 180°–200° F.) below the sealing temperatures. This distortion of oriented polypropylene results in buckling and separation of the polypropylene from a mounting surface.

The strip 61 and adhesive layer 62 may be preformed as a tape which is applied by machine to the blank 1A.

Neither strip 61 or adhesive layer 62 has direct contact with the container contents, so governmental approval for the materials from which the fillet components are fabricated may not generally be required. Nevertheless, strip materials and adhesives approved for food contact are available.

The stiffness of the fillet 56 must be such that the panel with the attached fillet has greater stiffness than a panel without the fillet. Expressed in another way, the fillet 56 must enable the panel 46 and/or 47 to carry and transfer a greater longitudinal force to open the container. This relationship may be expressed as follows:

$$E_2 > E_1(h_1)^3/(h_2)^3$$

where:

$E_1$ = modulus of elasticity of panel.

$E_2$: modulus of elasticity of panel + fillet.

$h_1$ = thickness of panel.

$h_2$ = thickness of panel + fillet.

For hermetic sealing containers, it is preferred that $E_2$ be greater than $0.2\times10^6$ pounds per square inch ($1.406\times10^8$ kg per square meter) to provide the desired stiffness. The thickness of the panel or panel plus fillet affects the resistance to buckling and bending. The adhesive is important in rigidity spacing strip 61 from the panel surface to provide the necessary effective thickness of the panel and fillet. The adhesive used may be sealable by pressure, heat, or other process, but is preferably a pressure-sensitive adhesive whose bonding strength is increased by the container sealing process.

Figure 6:
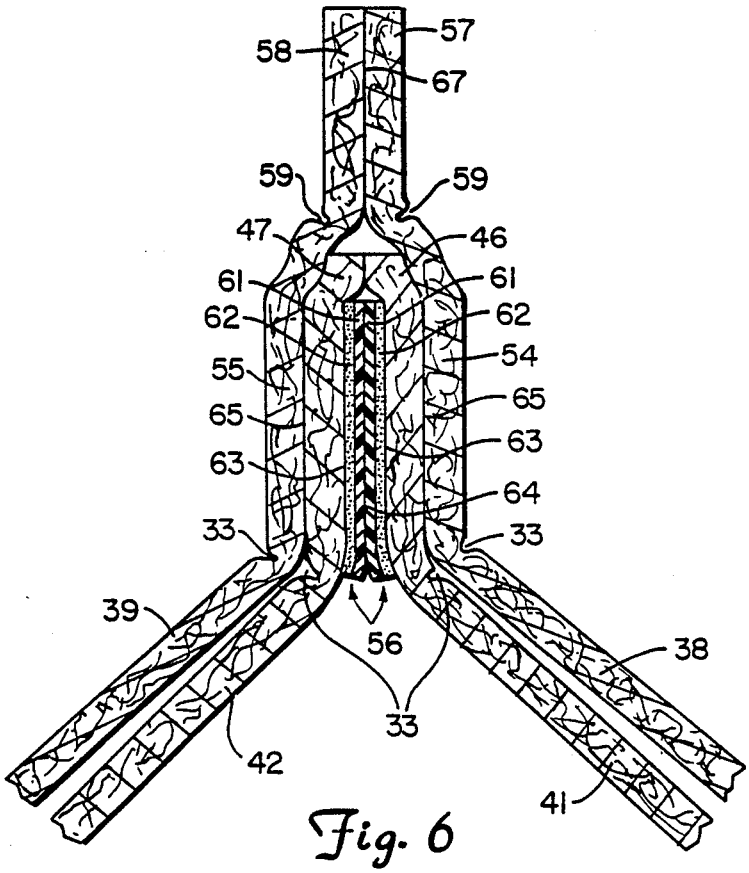
FIG. 6 is a cross-sectional view through the closed upper closure of one embodiment of the invention, taken along line 6—6 of FIG. 1.

FIG. 6 is an enlarged cross-sectional view through the rib portion of a container formed from this invention, showing the panel members and fillet exaggerated in thickness for the sake of clarity. It is understood that all of the panel members shown may include a thermoplastic coating on at least one of the blank surfaces, and preferably on both the inner and outer surfaces. Additionally, the panel members may include a film or foil of gas-impermeable material such as aluminum, overcovered by the thermoplastic coating.

First and second roof rib panels 54 and 55 overlie first and second gable rib panels 46 and 47. The gable rib panels 46 and 47 are separated from foldback panels 41 and 42 by scorelines 45, and the roof rib panels 54 and 55 are likewise separated from roof wing panels 38 and 39 by scorelines 45. Upper rib panels 57 and 58 are separated by score line 59 from the roof rib panels 54 and 55, and extend upwardly therefrom. Each of the panels shown in the figure may include a coating of thermoplastic on at least one of the surfaces. Stiffening fillet 56 is shown attached to the outer face 63 of gable rib panels 46 and 47. The fillet includes resistant strip 66 and adhesive layer 72, so that when the container is closed and sealed, as shown here, the surfaces 69 of the folded strip 61 form a strip-strip interface 64 with an intervening adhesive.

Fillet 56 may comprises a tape having a relatively thick backing or strip 61 of a stiff material whose bond to itself is weaker than its bond to adhesive layer 62. The adhesive layer 62 may be thermoplastic in nature, but preferably is a pressure-sensitive adhesive. The latter affords easier positioning during application to the blank IA, and does not require the application of heat for positioning. However, the thermal carton sealing process has been found to significantly enhance the sealing strength of the pressure-sensitive adhesives (PSA's) which were tested.

In FIG. 6, the container contents occupy the space between panel 38 and panel 41, and the space between panel 39 and panel 42. The spout seal interface 65 between gable rib panels 46, 47 and respective roof rib panels 54, 55 may include an adhesive layer, if bonding of the panels is not desirable. In other cases, such as in hermetic seals, these panels are bonded by fusing of the thermoplastic coating on the panels, by adding adhesives, or by other means. If the panels are bonded tightly along interface 65, the force required to break the seal and open the container spout may be considerably greater than the gable rib panels can transfer. Use of the fillet enhances the force carrying capability of the gable rib panels to provide an openable container.

When the first sealing process is thermal in nature, the upper rib panels, the gable rib panels, and the roof rib panels are heated to the softening or melting point of the thermoplastic coating, and compressed together as shown in FIG. 6. The upper rib panels are bonded on their inner surfaces at interface 67, providing the major bonding to maintain the integrity of the gable top during handling and storage.

The adhesion of strip 61 to the pouring spout panels such as gable rib panels 46 and/or 47 should preferably produce a peel strength greater than 50 oz. per inch of width (612 grams per cm width) at room temperature, so that the fillet will remain an integral part of the panel to which it is attached, both before and after the spout panels are unsealed and unfolded.

The thickness of both the strip 61 and the adhesive layer 62 will depend upon the force which must be transferred by the gable rib panels, the modulus of elasticity of the strip, and to a lesser extent, the adhesive properties. The same resistance to buckling can be achieved with various combinations of adhesive thickness, strip thickness, strip material and type of adhesive. For example, when a polyester strip is used, a strip thickness of 0.001–0.004 inch (0.0025–0.01 cm) is generally desirable, and an adhesive layer of the same range of thickness may be optimal for achieving the desired additional stiffness. A fillet adhesive layer of about 0.002 inch (0.005 cm) has proven optimal for certain pressure-sensitive adhesives used in fillets to reinforce polyethylene coated containers. With other adhesives, a thickness of up to 0.004 inch (0.0102 cm) may be used. Even monomolecular layers of adhesives may be used in the fillet. However, for strips constructed of unoriented polypropylene, an adhesive layer having a thickness of approximately 0.003 inches (0.008 cm) has been found to be preferred.

Figure 7:
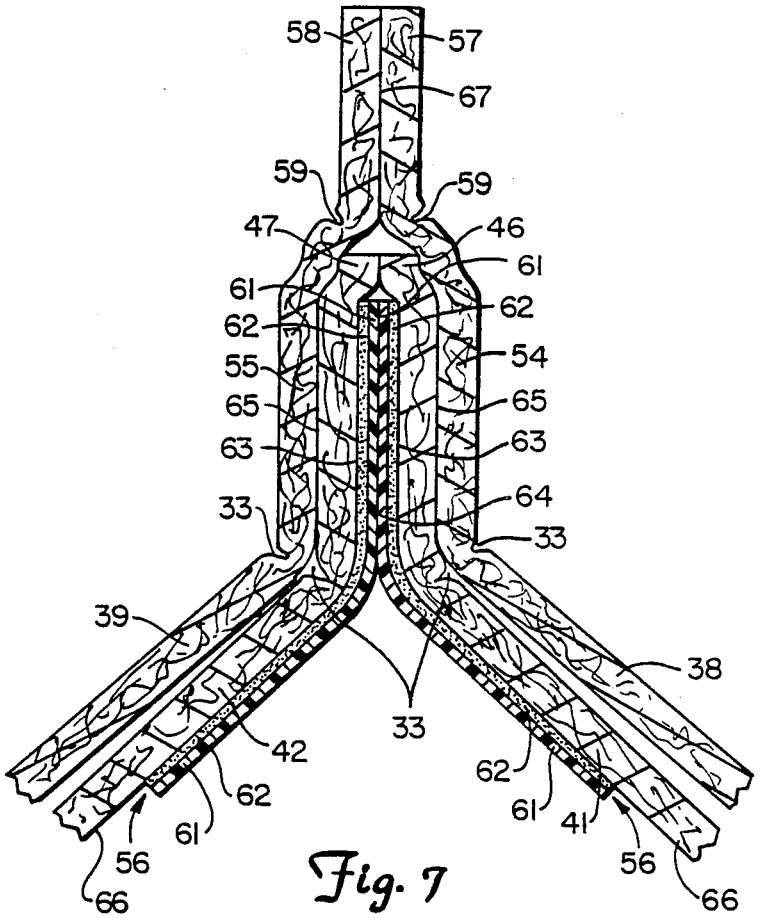
FIG. 7 is a cross-sectional view through the closed upper closure of a further embodiment of the invention, taken along line 6—6 of FIG. 1.

FIG. 7 shows a cross-section through another embodiment of this invention. This embodiment differs from that of FIG. 6 in that the fillet 56 not only overcovers a portion of the gable rib panels 46 and 47, but also extends downward to overcover portions of the outside surfaces 66 of the foldback panels 41 and 42. Such downward extension adds stiffness to the entire spout, strengthening the gable rib panels 46 and 47. Furthermore, in a thermal container sealing process, the temperature of the foldback panels is not as high as that of the gable rib panels, and fillet 56 will not slip from its proper position. Some pressuresensitive adhesive materials tend to hold the strip less tightly when they are heated to a temperature of 250°–400° F. (81°–205° C).

Figure 8:
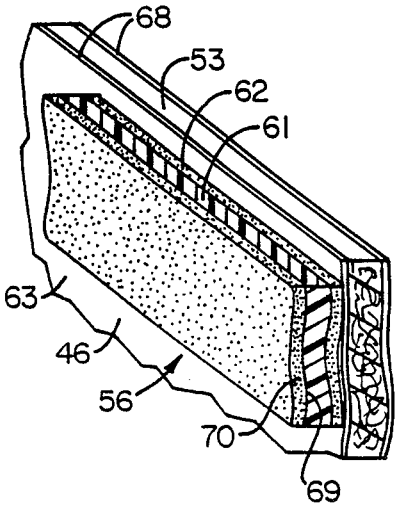
FIG. 8 is a perspective view of a portion of a stiffening fillet attached to a container panel according to a further embodiment of the invention, with the fillet and panel enlarged in cross-section.

FIGS. 8 and 9 depict a modification of the invention in which a secondary layer 70 of adhesive overcovers surface 69 of strip 61. The panel 46, adhesive layers 62 and 70, and strip 61 are shown with exaggerated thickness for clarity. The secondary adhesive may be pressure-sensitive or activated by the container sealing process, e.g., elevated temperature. The bond strength of the secondary layer 70 is substantially less than the bond strength of the primary adhesive layer 62. Thus, in FIG. 8, strip 61 is shown fixedly attached to the outer surface 63 of gable rib panel 46 by adhesive layer 62. Secondary adhesive layer 70 overcovers the opposite surface of strip 1. When the container gable top is folded for closure, the mirror image fillets 56 on each of the gable rib panels 46 and 47 abut one another. The secondary adhesive layers 70 become joined, so that the outer surfaces 63 of the gable rib panels are sealed together.

FIG. 9 shows an exaggerated section through the rib portion of a closed and sealed container according to this embodiment. Roof wing panels 38, 39, foldback panels 41, 42, roof rib panels 54, 55, gable rib panels 46, 47, and upper rib panels 57, 58 are shown in the same manner as in FIGS. 6 and 7. A fillet 56 comprising strip 61, adhesive layer 62, and secondary adhesive layer 70 is attached to the outside surface 63 of each of the gable rib panels 46, 47. In this sealed condition, the two secondary layers 70 become joined to effectively form a single layer 71. Layer 71 may be adapted to delaminate within the layer itself, or to peel from one of the strip surfaces 69. The bond strength of layer 71 is substantially less than that of adhesive layer 62, so that the fillet or fillets 56 remain firmly attached to the gable rib panels 46, 47 during the use of the container.

If desired, the fillet or fillets 56 may extend downwardly to over-cover portions of foldback panels 41 and 42 in a manner similar to that previously shown in FIG. 7.

An advantage of this embodiment is that the secondary bonding strength can be varied over a wide range to achieve the desired first stage opening force requirement. The bonding strength may range from essentially zero up to a strength slightly less than the strength of the gable rib panels 46 and 47.

FIGS. 10 through 13 show a portion of the blank 1A, including those panels which become the pouring spout. These figures depict various embodiments of fillet 56 in terms of the particular panel area or areas covered thereby. Each figure shows panels 3–5, 29, 31–32, 38–39, 41–42, 46–47, 54–55, and 57–58, with one or more fillets 56 attached to the gable rib panels 46, 47.

In FIG. 10, a single fillet 56 overcovers all or a portion of both gable rib panels 46 and 47. The upper edge 72 of fillet 56 is shown as generally continuous with the upper free edge 53 of the gable rib panels, but it may be spaced therefrom, either upward or downward. Preferably, upper edge 72 does not extend above free edge 53 by more than 0.15 inch (0.38 cm) When the gable rib panels are coated with thermoplastic, a fillet covering all of the panels effectively removes the adhesive effect of the thermoplastic upon the required first stage opening force. When the upper edge 72 of fillet 56 is lower than free edge 53 by more than 0.3 inches (0.76 cm), an excessive sealing area for the thermoplastic carton sealing process may result. This produces a strong seal which may require an excessive opening force to break the seal.

When the fillet or fillets 56 are adhesively attached to both gable rib panels 46 and 47, and the upper edge 72 of the fillets extend above the upper free edge 53 of the gable rib panels, the exposed portion of adhesive layers 62 will become bonded to the roof rib panels 54 and 55. Therefore, it is generally desirable to limit such upward extension of the fillet or fillets 56 above the gable rib panels 46 and 47 to not more than 0.15 inches (0.38 cm), unless the adhesive of layer 62 has a relatively low bonding strength. High bond strength in layer 62 may result in tearing or delamination of the roof rib panels 54 and 55.

Each end of the fillet 56 may be spaced from scorelines 8 and 9, if desired.

Figure 11:
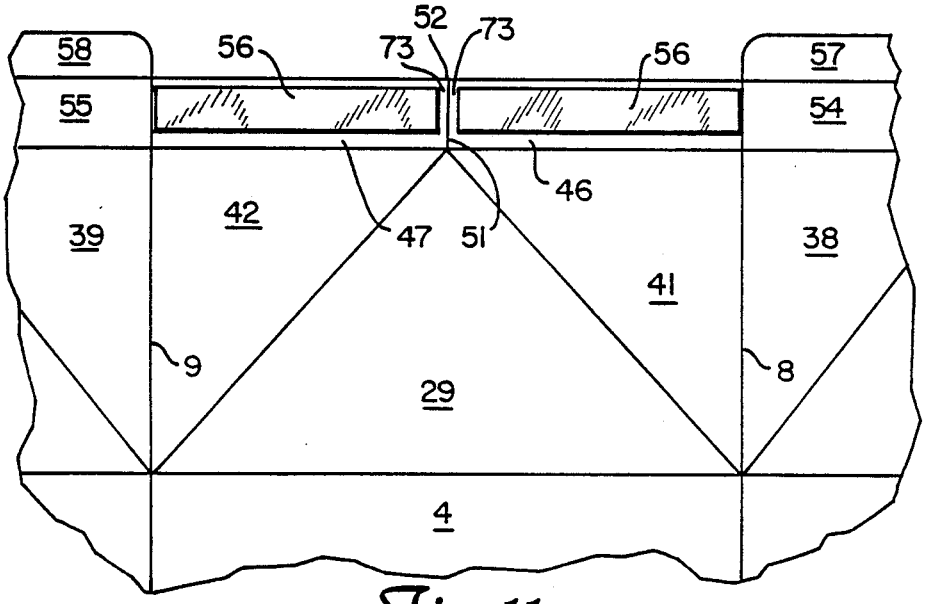

FIG. 11 illustrates a blank with two fillets 56 overcovering a portion of the gable rib panels 46 and 47.

Each fillet 56 is spaced from scoreline 51. This spacing 73 permits the gable rib panels 46, 47 to more readily fold along scoreline 51 when the container is closed and sealed. In order to transfer the required opening forces to scoreline 51, however, spacing 73 must be reasonably limited. Thus, for a half-gallon container with gable rib panels 46, 47 or 1.5–2.0 inches length, fillet 56 must not be spaced from scoreline 51 by more than 0.6 inches (1.5 cm). Preferably, the spacing 73 between scoreline 51 and fillet 55 is no more than 0.3 inches (0.76 cm).

Fillet 56 may also extend downwardly to overlie an upper portion of foldback panels 41 and 42. Furthermore, this downward extension may overcover an upper portion of first triangular end panel 29. This mode is illustrated in both FIGS. 12 and 13.

The advantage of this downward extension is evident when the container sealing process is one which affects the bonding strength of the fillet adhesive layer 62. In common heat sealing processes used to seal polyethylene coated blanks, heat is directly applied to the panels to be sealed, i.e., the rib panels. Panels below the rib panels are only incidentally heated and attain a considerably lower temperature. The sealing temperature is difficult to accurately control, and if the fillet adhesive layer 62 softens excessively, the fillet strip 61 may slide downward, not retaining its proper alignment on the gable rib panel or panels 46 and 47. The portion of the fillet 56 below the gable rib panels will be much less affected because of the lower temperature, and will maintain the desired original position of the fillet. The adhesion of adhesive layer 62 is regained upon cooling.

FIG. 12 shows the fillet as overlying score line intersection 74 at the top of triangular end panel 29, and extending downward to overcover portions of the foldback panels 41, 42 and triangular end panel 29.

It has been discovered that enhanced sealing results from slotting the fillet 56 where it overcovers the common gable rib scoreline 51. Thus, in FIG. 13, fillet 56 includes a slot 75 extending downwardly from the upper edge 72 of the fillet, along at least a portion of the common line 51. This enables easier folding of the gable rib panels 46, 47, without distortion along line 51. The notch may optionally extend downwardly to expose intersection 74, or may extend downward as a slot through the fillet to divide it into two fillets. When a notch or slot exposes the common line 51, the edge of the fillet strip is preferably separated form a portion of the common line by no more than 0.3 inches (0.76 cm). When there are two fillets, each overcovering a portion of one of the gable rib panels, the maximum spacing of each fillet from common line 51 is also preferably 0.3 inches (0.76 cm) A greater spacing may result in insufficient stiffening of the panels in the vicinity of common line 51.

EXAMPLE 1

Commercial hermetically sealed 0.5 gallon (1.9 liter) gable-top containers were manually opened. After folding back the wing panels, simple forward hand pressure on the roof rib panels resulted in buckling and distortion of the gable rib panels, without opening the tip of the spout at the common fold line. In all cases, insertion of a knife blade between the gable rib panels and roof rib panels near the common fold line was required to open the spout.

Container blanks of the same material were sealed by hand, using a Liquipak TM model 010 hand sealer. Attempts to open the containers produced the same results as were obtained with the commercially sealed containers. An applied force of 15 pounds-force (6.8 kg-force) resulted in tearing and buckling of the panels, without opening the spout.

The opening force required by a previously opened hermetically sealed carton was determined to be abut 2.6 pounds-force (1.2 kg-force).

For the sake of comparison, a common milk carton opened from the sealed condition with an applied force of about 3.0 pound-force (1.36 kg-force), without tearing of the spout panels. This carton is sealed only to the extent of preventing liquid leaks, and a hermetic barrier is not provided.

EXAMPLE 2

Several types of fillet were applied to polyethylene coated cardstock for determining the effect upon panel stiffness and ease of container opening.

The container material was manufactured by International Paper Company for hermetically sealed cartons, and comprised paperboard having an aluminum film bonded to the inside surface, and both sides then coated with thermoplastic polyethylene.

The types of adhesive used in the fillets included (a) ethylene-vinyl acetate (EVA) copolymer, (b) medium density polyethylene (MDPE), and (c) a pressure-sensitive adhesive (PSA).

The modulus of elasticity was determined by measuring the deflection caused by a weight placed on the center of a simple beam formed from the cardstock. Measurements were made on the cardstock itself, on a pair of gable rib panels from a blank, and from the entire outer spout assembly comprising the gable rib panels, triangular end panel, and foldback panels. The formula used to calculate the modulus was:

$$E=fL^3 4ba^3 Y$$

where

E=modulus of elasticity.
f=force applied, 0.11 pound (50 g) for most tests.
a=thickness of beam.
b=width of beam, 1.0 inch (2.54 cm).
Y=deflection, inches (cm).
L=length of beam=3.7 inches (9.4 cm).

The results were as follows:

| Beam Material | a Thickness | Y Deflection | E, Modulus, PSI (kg/cm$^2$) |
|---|---|---|---|
| Cardstock (unreinforced) | 0.027 in. (0.069 cm) | 0.18 in. (0.46 cm) | 393,000 ($2.76 \times 10^8$) |
| Cardstock with transverse scoreline. (f = 10 g because of reduced modulus) | 0.027 in. (0.069 cm) | 0.33 in. (0.84 cm) | 28,000 ($0.2 \times 10^8$) |
| Cardstock with fillet of 0.004 in. (0.010 cm) polyester and 0.002 in (0.005 cm) EVA adhesive (Scotchpak TM 26 tape) | 0.036 in. (0.091 cm) | 0.090 in. (0.23 cm) | 332,000 ($2.33 \times 10^8$) |
| Cardstock with fillet of 0.002 in. (0.005 cm) polyester and 0.003 in. | 0.032 in. (0.079 cm) | 0.12 in. (0.30 cm) | 390,000 ($2.7 \times 10^8$) |

-continued

| Beam Material | a Thickness | Y Deflection | E, Modulus, PSI (kg/cm$^2$) |
|---|---|---|---|
| (0.0075 cm) PSA | | | |
| Spout panels, not preflexed | 0.027 in | 0.080 in. | 885,000 |
| | (0.069 cm) | (0.20 cm) | (6.2 × 10$^8$) |
| Spout panels, preflexed | 0.027 in. | 0.21 in. | 337,000 |
| | (0.069 cm) | (0.53 cm) | (2.4 × 10$^8$) |
| Polyester Film (Literature Value) | | | 400,000 |
| | | | (2.8 × 10$^8$) |

The results indicate that the modulus of elasticity is approximately the same, i.e., $0.4\times10^6$ psi ($2.8\times10^8$ kg/m$^2$) for preflexed panels, either with or without the added fillet.

Buckling forces were calculated from the data of Table 2 using $$P_{crit}=CEh^3b/12L^2,$$

where $P_{crit}$: is the forward-directed force merely required to open the preflexed spout from a closed but unsealed condition, lb-force;

C: is pi$^2$,

E: is the modulus of elasticity, approximately $0.4\times10^6$ psi;

h: is thickness, 0.027 inches (0.069 cm);

b: is width, 1.0 inch (2.54 cm); and

L: is length, 3.7 inches (9.40).

The calculated force required to open the unsealed spout of unreinforced cardstock was 0.5 pounds (0.23 kg.).

The force carried by both of the unreinforced gable rib panels prior to buckling was calculated to be 1.9 pounds (0.86 kg.), using L=1.85 inches. This leaves 1.9–0.5=1.4 pounds (0.64 kg.) of force for breaking the bond at the tip of the spout.

Reinforcement of the gable rib panels with a 0.002 inch (0.005 cm) thick polyester strip and 0.002 inch (0.005 cm) layer of PSA adhesive provided a higher calculated available force of 2.9–0.5=2.4 pounds for breaking the bond at the spout tip. In this case, the net panel thickness was 0.031 inches (0.079 cm.).

Reinforcing the gable rib panels with 0.004 inch (0.010 cm) thick polyester and a 0.002 inch (0.005 cm) layer 62 of EVA adhesive provided a calculated available force of 4.6–0.5=4.1 pounds (2.09 kg.) for breaking the bond at the spout tip. In this case, the net panel thickness was 0.036 inches (0.142 cm). Thus, as a thicker, stiffer reinforcement strip is added, the ability to transfer applied forward-directed opening forces for opening the spout tip greatly increases.

Measurements were made of the force required to open a previously opened gable top hermetic sealing carton, using a spring gauge. The average measured force of 2.4 pounds (1.09 kg.) included the force required to buckle the extreme tip of the unreinforced spout, that is, the common fold line of the gable rib panels. Thus, the calculated value of the force transmitted by the unreinforced spout panels is only 1.9 pounds (0.86 kg.), nearly equal to the measured force of 2.4 pounds (1.09 kg) required to open the previously opened carton. This demonstrates that the greater joint strength of a sealed spout will result in buckling of the cardstock when opening forces are applied to the spout panels. On the other hand, when the gable rib panels were reinforced with a fillet according to this invention, the added stiffness provided an available opening force greater than 2.4 pounds to the common fold line, and the containers were opened without buckling or delamination of the panels.

With polyethylene coated blanks made for hermetic sealing, and similar gable top containers, ease of second stage opening will be enhanced by (a) an increase in gable rib area covered by the fillet, (b) fillets of greater stiffness, (c) slotting the fillet 56 along the common fold line 51 between the gable rib panels, (d) leaving uncovered the score line intersection 74 where the triangular end panel 29 touches the common fold line, and (e) a reduction of fillet 56 area which extends above the gable rib panels 46, 47 to seal to the roof rib panels 54 and 55.

EXAMPLE 3

Several types of adhesive tapes were evaluated for use as fillets, that is, for ease of positioning on the gable rib panels and adhesion to the gable rib panels. The following tapes were applied to gable rib panels of polyethylene-coated container blanks, which were then heat-sealed.

Scotchpak TM 26: 0.004 inch (0.01 cm) polyester backing as the strip, with 0.002 inch (0.005 cm) EVA adhesive.

Scotchpak TM 48: 0.0005 inch (0.0012 cm) polyester backing with 0.004 inch (0.01 cm) MDPE adhesive.

Scotchtab TM 0.002 inch (0.005 cm) polyester backing as the strip, with 0.002 inch (0.005 cm) PSA adhesive.

Scotchpak TM 26 with 0.003 inch (0.0075 cm) PSA adhesive applied over the EVA adhesive.

Polyester/PSA: 0.002 inch (0.005 cm) polyester film backing as the strip, with 0.003 inch (0.0076 cm) PSA adhesive.

Control: No fillet.

The pressure-sensitive adhesive (PSA) used in this test was a typical rubber resin adhesive.

The results of the tests were as follows:

Scotchpak TM 26 with EVA adhesive was difficult to position for sealing, and required preliminary heat sealing to provide a good seal.

Scotchpak TM 48 with MDPE adhesive was difficult to position and required preliminary heat sealing. Insufficient stiffness was added by the fillet to consistently transfer the required opening forces to the spout tip.

Scotchtab TM with PSA adhesive was easy to position, and required heat sealing to strongly bond to the panels. Sufficient opening forces were transferred.

Scotchpak TM 26 with PSA adhesive was easy to position, and heat-sealing provided a good seal. Sufficient opening forces were transferred to open the seal.

The control gable top carton spout, heat-sealed according to the commercial process, could not be opened without buckling and delamination of the cardstock.

EXAMPLE 4

An unoriented polypropylene adhesive tape was evaluated as a stiffening fillet in a one-half gallon gable top container blank, which was then heat sealed with a Liquipak Model 010 heat sealer.

The tape was applied to the outside of the spout flush to the spout edge. The fillet was one-and-one-half of an inch wide and three and three eights of an inch long. The fillet was centered on the spout tip.

The tape had a 0.0065 inch thick unoriented polypropylene backing and a 0.003 inch thick rubber/resin pressure sensitive adhesive.

The carton was opened in the normal manner. The carton opened with difficulty but did open. The inside spout lips had fully bonded and had full paper tear when opened. A similar carton without the fillet would have a force in excess of 12 pounds applied and would buckle and not open.

The polypropylene was not significantly bonded to itself.

While the present invention has been particularly set forth in terms of specific embodiments thereof, it will be understood in view of the instant disclosure that numerous variations upon the invention are enabled to those skilled in the art, which variations yet reside within the scope of the present teaching. Accordingly, this invention is to be broadly construed, and limited only by the scope and spirit of the claims now appended hereto.

What is claimed is:

1. A sheet material blank for constructing a sealed gable-top container having inner and outer surfaces responsible to a container sealing process, said blank comprising:

(a) a container body having sides, a bottom, and a top;

(b) an extensible pouring spout including first and second substantially triangular end panels connected to said container body top, first and second foldback panels, said first foldback panel connected to one lateral edge of said first triangular end panel, and said second foldback panel connected to another lateral edge of said first triangular end panel, a first roof wing panel adjoining said first foldback panel and connected thereto, a second roof wing panel adjoining said second foldback panel and connected thereto, third and fourth foldback panels, said third foldback panel connected to a first roof panel and to one lateral edge of said second triangular end panel, and said fourth foldback panel connected to another lateral edge of said second triangular end panel and adapted to be connected to a second roof panel, first and second gable rib panels connected to upper edges of said first and second foldback panels, respectively, to extend upwardly therefrom, having upper edges and lateral edges, and connected to each other at a common line, third and fourth gable rib panels connected to upper edges of said third and fourth foldback panels, respectively, and to each other, first and second roof rib panels connected to the upper edges of said first and second roof panels, respectively, each of said roof rib panel connected at one side thereof to one of said first and second gable rib panels, first and second upper rib panels connected to upper edges of said first and second roof rib panels, respectively, and (c) at least one stiffening fillet overlying a portion of, and bonded to an outer surface of at least one of said pouring spout panels, for stiffening said at least one said panel to transfer applied opening forces along said at least one said panel to open said container, said fillet comprising (x) a strip of material constructed of unoriented polypropylene resistant to the container sealing process and having a modulus of elasticity of at least $0.1 \times 10^6$ psi, and (xx) a layer of adhesive attached to one side of said strip and to said outer surface of said at least one side panel for bonding said strip thereto.

2. The blank according to claim 1, wherein at least one of said inner and outer surfaces is a thermoplastic responsive to a container sealing process of elevated temperature and pressure, and said strip is resistant to said elevated temperature and pressure.

3. The blank according to claim 2 wherein said blank is adapted to be formed into a container by a container sealing process at a temperature of 260°-320° F. (121°-205° C.) wherein panels to be sealed are compressed together.

4. The blank according to claim 1 wherein said fillet comprises a tape having said layer of adhesive preapplied on one side thereof.

5. The blank according to claim 4 wherein the adhesion peel strength of said tape to said surface of said sheet material equals or exceeds 50 ounces force per inch (612 gram-force per cm.) of tape width.

6. The blank according to claim 1 wherein said adhesive comprises a pressure-sensitive adhesive.

7. The blank according to claim 1 wherein mirror image portions of said foldback panels are overcovered by said fillet having said adhesive layer on one surface of said strip thereof, and further comprising a layer of secondary adhesive covering a portion of the opposite surface of said strip on at least one of said foldback panels, wherein said secondary adhesive delaminates or peels under applied opening forces to separate said panel surfaces joined by said secondary adhesive.

8. A sealed gable-top container having a thermoplastic outer surface coating, said container comprising:

(a) a container body having sides, a bottom, and a top;

(b) an extensible pouring spout including: first and second substantially triangular end panels each connected to an upper edge of one of said container panels, first and second foldback panels, said first foldback panel connected to one lateral edge of said first triangular end panel, and said second foldback panel connected to another lateral edge of said first triangular end panel, a first roof wing panel adjoining said first foldback panel and connected thereto, a second roof wing panel adjoining said second foldback panel and connected thereto, third and fourth foldback panels, said third foldback panel connected to a first roof panel and to one lateral edge of said second triangular end panel, and said fourth foldback panel connected to another lateral edge of said second triangular end panel and connected to a second roof panel, first and second gable rib panels connected to upper edges of said first and second foldback panels, respectively, and extending upwardly therefrom, and to each other at a common line, third and fourth gable rib panels connected to upper edges of said third and fourth foldback panels, respectively, and to each other, first and second roof rib panels connected to upper edges of said first and second roof panels, respectively, each said roof rib panel connected at one side thereof to one of said first and second gable rib panels;

first and second upper rib panels connected to upper edges of said first and second rib panels, respectively;

(c) at least one stiffening fillet overlying a portion of, and bonded to the outer surface of at least one of said pouring spout panels, for stiffening said at least one said panel to transfer applied opening forces along said at least one said panel to open said container, said fillet comprising (x) a strip of material constructed of unoriented polypropylene resistant to the container sealing process and having a modulus of elasticity of at least $0.1 \times 10^6$ and (xx) a layer of adhesive attached to one side of said strip and to said outer surface of said at least one said panel for bonding said strip thereto.

9. The container according to claim 8 wherein the surface of said strip opposite said adhesively bonded fillet is bonded by a secondary adhesive layer of lower bonding force than said bonding force between said strip and said panel surface, for peeling or delamination under applied opening forces.

* * * * *

UNITED STATES PATENT AND TRADEMARK OFFICE

CERTIFICATE OF CORRECTION

PATENT NO. : 4,872,562

DATED : October 10, 1989

INVENTOR(S) : GREGORY R. WYBERG

It is certified that error appears in the above-identified patent and that said Letters Patent is hereby corrected as shown below:

Col. 6, line 35; insert --42-- before the word "away".

Col. 8, line 3; "3" should read --30--.

Col. 10, line 8; ":" should read --=--.

Col. 10, line 54; "IA" should read --1A--.

Col. 11, line 52; "pressuresensitive" should read --pressure-sensitive--.

Col. 11, line 67; "1" should read --61--.

Col. 18, line 63; insert --roof-- before the word "rib".

Signed and Sealed this

Fifteenth Day of October, 1991

*Attest:*

HARRY F. MANBECK, JR.

*Attesting Officer*

*Commissioner of Patents and Trademarks*